US010450762B2

(12) United States Patent
Schluter

(10) Patent No.: US 10,450,762 B2
(45) Date of Patent: Oct. 22, 2019

(54) TILE END PROFILE

(71) Applicant: Werner Schluter, Iserlohn (DE)

(72) Inventor: Werner Schluter, Iserlohn (DE)

(73) Assignee: Schluter Systems L.P., Plattsburgh, NY (US)

( * ) Notice: Subject to any disclaimer, the term of this patent is extended or adjusted under 35 U.S.C. 154(b) by 0 days.

(21) Appl. No.: 15/968,960

(22) Filed: May 2, 2018

(65) Prior Publication Data

US 2018/0334813 A1 Nov. 22, 2018

(30) Foreign Application Priority Data

May 18, 2017 (DE) ..... 20 2017 102 994.8

(51) Int. Cl.
*E04F 19/06* (2006.01)

(52) U.S. Cl.
CPC ..... *E04F 19/061* (2013.01)

(58) Field of Classification Search
CPC ..... E04F 19/061
USPC ..... 52/272, 281, 282.1, 282.3, 287.1, 254, 52/256, 257, 179, 180, 181, 831, 842, 52/846, 851
See application file for complete search history.

(56) References Cited

U.S. PATENT DOCUMENTS 617,881 A * 1/1899 Marsh ..... E04F 13/06 52/256
640,409 A * 1/1900 Parker ..... E04F 13/06 52/256
688,181 A * 12/1901 Koch ..... E04F 13/06 52/255
1,122,076 A * 12/1914 Collins ..... E04F 13/06 52/255
1,196,753 A * 9/1916 Alms ..... E04F 13/06 52/256
1,537,758 A * 5/1925 Fischer ..... E04F 13/06 52/256
1,624,121 A * 4/1927 Thiem ..... E04F 13/06 52/255
2,319,345 A * 5/1943 Putnam ..... E04C 1/40 404/8
2,332,146 A * 10/1943 Holdsworth ..... E04F 13/06 52/255

(Continued)

FOREIGN PATENT DOCUMENTS

DE 4406890 A1 9/1995
DE 29809789 U1 9/1998

(Continued)

*Primary Examiner* — Brent W Herring
(74) *Attorney, Agent, or Firm* — Thorpe North & Western, LLP

(57) ABSTRACT

An elongate profile (1) for terminating installed tiles includes, viewed in cross-section, a fastening leg (4) for fixing the profile to a base (10), wherein the fasting leg (4) defines a contact surface (2) and is provided with passage openings (3), and a boundary leg (5) adjoining the fastening leg (4) substantially vertically, wherein the outside (7) of the boundary leg (5) defines a visible surface. A stop leg (8) is further provided directly adjacent to the boundary leg (5) and extending downwardly in the direction of the fastening leg (4), the stop leg (8) including an angle (α) with the boundary leg (5) in the range between 5 and 30° and having a plurality of through holes (9).

13 Claims, 7 Drawing Sheets

(56) References Cited

U.S. PATENT DOCUMENTS 2,391,581 A * 12/1945 Markuson ..... E04F 13/06 52/253
2,483,888 A * 10/1949 Danielson ..... E04F 13/06 4/538
2,969,616 A * 1/1961 Gustafson ..... E04F 13/06 52/255
3,295,268 A * 1/1967 Gaither ..... E04F 13/06 52/255
3,307,313 A * 3/1967 Tatum ..... E04F 13/06 52/255
3,589,087 A * 6/1971 De Lazzero ..... E04F 11/166 52/181
4,391,074 A * 7/1983 Holsman ..... E04F 13/04 52/257
4,858,404 A * 8/1989 Schluter ..... E04F 11/163 52/179
5,073,430 A * 12/1991 Aidan ..... E04F 19/061 428/192
5,144,778 A * 9/1992 Pourtau ..... E04F 19/061 52/254
5,181,357 A * 1/1993 Pourtau ..... E04F 19/049 425/131.1
5,433,986 A * 7/1995 Moscatello ..... E04F 19/061 428/120
6,047,506 A * 4/2000 Kemper ..... E04F 11/166 52/179
6,141,920 A * 11/2000 Kemper ..... E04F 11/166 52/179
6,338,229 B1 * 1/2002 Botzen ..... E04F 13/06 52/287.1
7,389,613 B2 * 6/2008 Sondermann ..... E04F 19/061 52/179
8,716,624 B2 * 5/2014 Johnson ..... B21D 5/086 219/121.64
2005/0039409 A1 * 2/2005 Sondermann ..... E04F 19/061 52/179
2008/0110126 A1 * 5/2008 Howchin ..... E04C 3/07 52/630
2009/0178369 A1 * 7/2009 Pilz ..... E04B 1/24 52/781.3
2010/0287872 A1 * 11/2010 Bodnar ..... E04C 3/09 52/582.1
2013/0000187 A1 * 1/2013 Raisacher ..... A01G 17/14 47/46

FOREIGN PATENT DOCUMENTS

DE 202006019436 U1 3/2007
DE 102007002639 A1 7/2008
DE 202009002336 U1 7/2010
EP 0627534 A2 12/1994
EP 1918486 A2 5/2008
GB 2452378 A 3/2009
JP 20140177809 A 9/2014
WO WO 98/54423 A1 12/1998

* cited by examiner

TILE END PROFILE

PRIORITY CLAIM

This application claims priority of and to German Patent Application Serial No. 20 2017 102 994.8, filed May 18, 2017, which is hereby incorporated herein by reference in its entirety.

BACKGROUND OF THE INVENTION

This invention relates to an elongate profile for terminating installed tiles.

SUMMARY OF THE TECHNOLOGY

Profiles are used to terminate tiles laid in thin-bed mortar at the end of the tiling or in the joint area of adjacent tilings. They form an optical finish of a tiling. In addition, they protect the end faces of the tiles against damages. For the purposes of this application, the term "tiles" is understood as a generic term for panel-shaped covering material made of ceramic, natural or artificial stone. The term "thin-bed mortar" defines any type of adhesive and/or tile adhesive with which tiles can be laid using the so-called thin-bed method.

When installing a profile of the type mentioned above, the fastening leg is arranged between a tile and the base and is embedded in a thin-bed mortar used to fix the tile, the thin-bed mortar penetrating the passage openings of the fastening leg. In this way, the profile is securely held to the base after the thin-bed mortar has cured. The boundary leg, whose width is adapted to the thickness of the tiles, is positioned in such a way that a gap of a desired width remains between it and the end faces of the adjacent tiles, which can subsequently be filled with grout.

A profile of the type mentioned above that is manufactured as an extruded profile and exclusively consists of a fastening leg and a boundary leg with different material thicknesses, is sold by Schlüter-Systems KG under the product name Schlüter-SCHIENE-V, for example.

Furthermore, profiles of the type mentioned above are known which, in addition to a fastening leg and a boundary leg, have an end leg immediately adjoining the boundary leg and defining a free end of the profile which extends substantially vertically to the boundary leg. Such end legs serve to achieve an optical widening compared to the material thickness of the profile. Examples are the profiles sold by Schlüter-Systems KG under the product name Schlüter-SCHIENE-AE, which are also realized as extruded profiles.

In case of profiles produced from a metal strip of constant material thickness by means of roller profiling or edging, it is also known to achieve an optical widening of the type described above by bending the free end of the boundary leg by 180° to form an end leg, resulting in a wider bending edge than the material thickness of the metal strip. Such a type is distributed by Schlüter-Systems KG under the product name Schlüter-SCHIENE-E.

Furthermore, profiles of the above mentioned type are known which, in addition to a fastening leg and a boundary leg, have a distancing projection which projects from a central area of the boundary leg and is brought into abutment with the end face of the adjacent tile during installation. The essential advantage of such a distancing projection is that an even joint width between the tiles and the profile can be set in a simple manner. In addition, an undercut chamber is formed to interlock the grout. The Schlüter-SCHIENE-AE profiles from Schlüter-Systems KG are another example in this context.

Based on this state of the art, it is an object of the present invention to create a profile of the type mentioned above with an alternative and stable structure that is easy to install and flexible to manufacture.

To solve this problem, this invention creates a profile of the type mentioned above, which is characterized in that a stop leg is provided directly adjacent to the boundary leg and extending downwards in the direction of the fastening leg, the stop leg enclosing an angle with the boundary leg in the range between 5 and 30° and having a plurality of through holes. The main advantage of such a stop leg is that a uniform joint width can be set on the upper visible surface, analogous to a distancing projection of the type described above, if it is brought into abutment with the end face of the adjacent tiles when profile is installed. In addition, the boundary leg is optically widened and additionally stabilized by flanging the stop leg. In order to ensure that grout can be placed safely and permanently between the profile and the adjacent tiles, despite the reduced grout absorbing space due to the position of the stop leg according to the invention, the stop leg is provided with through holes in which the grout can interlock.

According to an embodiment of this invention, the profile is made in one piece.

Preferably it is bent from a metal strip, whereby the metal strip is manufactured in particular from stainless steel, brass or aluminium and/or has a uniform material thickness of 0.4 to 1.2 mm, better still from 0.5 to 0.8 mm.

According to a variant of the present invention, an end leg adjoins the stop leg, which defines a free end of profile and extends in the direction of the boundary leg. In this way, a gap chamber of a defined size is formed between the boundary leg, the stop leg and the end leg, in which the grout passing through the through holes of the stop leg is absorbed.

Preferably the stop leg and the end leg extend substantially parallel to each other at a distance in the range between 0.5 and 2 mm, thus forming a gap chamber of optimized size. Alternatively, the distance between the stop leg and the end leg can increase in a wedge shape. Also, the stop leg and the end leg can lie closely against each other, whereby only the through holes then form an undercut for the interlocking of the grout.

The boundary leg of the profile according to the present invention can have an optically appealing arc-shaped curve extending across substantially 90°.

Alternatively, the boundary leg can also be L-shaped if an edgy design is preferred. Differently shaped boundary legs are also possible for optical or application-technical reasons.

According to an embodiment of the present invention, the fastening leg and the boundary leg are connected to each other by a connecting leg enclosing an angle between 3 and 20° with the fastening leg, in particular an angle between 5 and 15°, and being provided with a plurality of through holes. Such a connecting leg with through holes also forms a gap of a defined size in the area of outer corners during installation, in which the grout is safely and permanently absorbed due to the through holes.

Furthermore, the present invention creates a profile, in particular one of the type described above, which, viewed in cross-section, comprises a fastening leg for fixing the profile to a base, wherein the fastening leg is provided with through holes, and a boundary leg adjoining the fastening leg substantially vertically, wherein the outside of the boundary leg defines a visible surface, wherein the fastening leg is provided with at least one stiffening bead extending in the longitudinal direction and projecting in the direction of the boundary leg. The design of the fastening leg with such a stiffening bead is advantageous in that it prevents inadvertent bending of the profile during its storage, transport or handling.

Preferably, each bead extends along the entire length of the fastening leg, which results in a very stable arrangement and at the same time a simple structure.

Alternatively, multiple stiffening beads extending in the longitudinal direction and parallel to one another are provided along the entire length of the fastening leg.

Preferably the at least one bead has a depth which essentially corresponds to the material thickness of the fastening leg.

Further features and advantages of the present invention become clear from the following description of tile end profiles in accordance with different embodiments of the present invention with reference to the enclosed drawing.

DETAILED DESCRIPTION OF THE TECHNOLOGY

In the following same reference numbers refer to identically or similarly designed parts or components.

Figure 1:
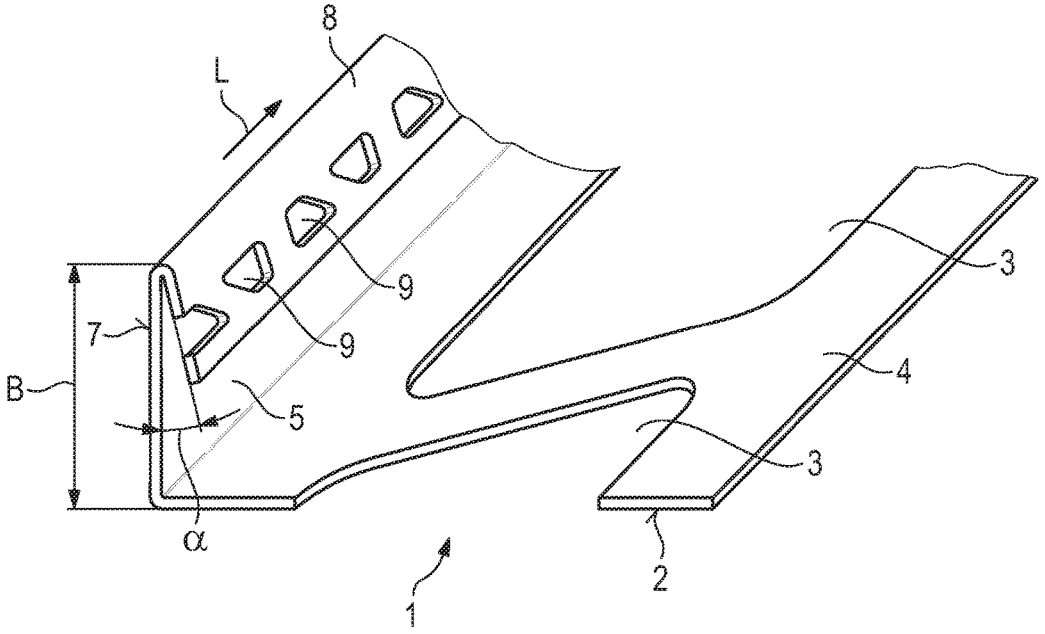
FIG. 1 is a perspective view of a profile according to a first embodiment of this invention.
Figure 2:
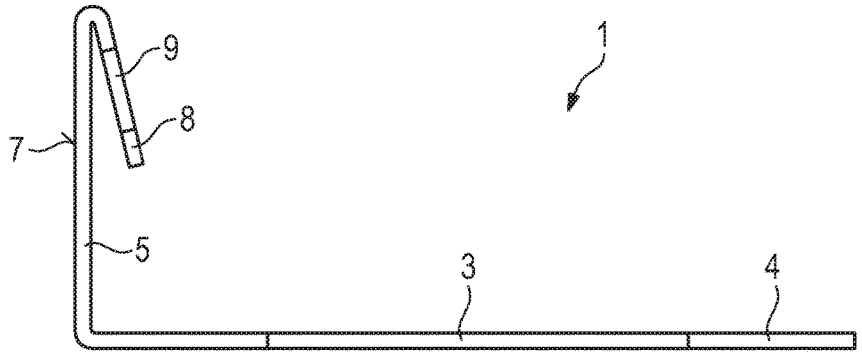
FIG. 2 is a side view of the profile shown in FIG. 1.

FIGS. 1 and 2 show a profile 1 according to a first embodiment of this invention, which is used to terminate the exposed end faces of the tiles of a tiling or of tilings that meet in corner areas, as it is explained below in more detail with reference to FIGS. 3 and 4. In the present case, the profile 1 is bent in one piece from an elongated metal strip, the metal strip being made in particular of stainless steel, brass or aluminium and having a uniform material thickness of 0.4 to 1.2 mm, in particular of 0.5 to 0.8 mm. Seen in cross-section, the profile 1 comprises a fastening leg 4 for fixing the profile to a base, wherein the fastening leg 4 defines a lower contact surface 2 and is provided with passage openings 3, a boundary leg 5 directly adjoining the fastening leg 4 and extending substantially vertically therefrom, wherein the width B of the boundary leg 5 is adjusted to a thickness S (FIG. 3) of tiles 6 to be installed and the outside 7 of the boundary leg 5 defines a visible surface, and a stop leg 8 directly adjoining the boundary leg 5 and extending downwards in the direction of the fastening leg 4, which encloses an angle $\alpha$ in the range between 5 and 30° with the boundary leg 5. The stop leg 8 is provided with a plurality of through holes 9, which are formed in the longitudinal direction L in a uniform distribution. The passage openings 3 of the fastening leg 4 and the through holes 9 of the stop leg 8 are normally punched before the metal strip is bent into shape.

Figure 3:
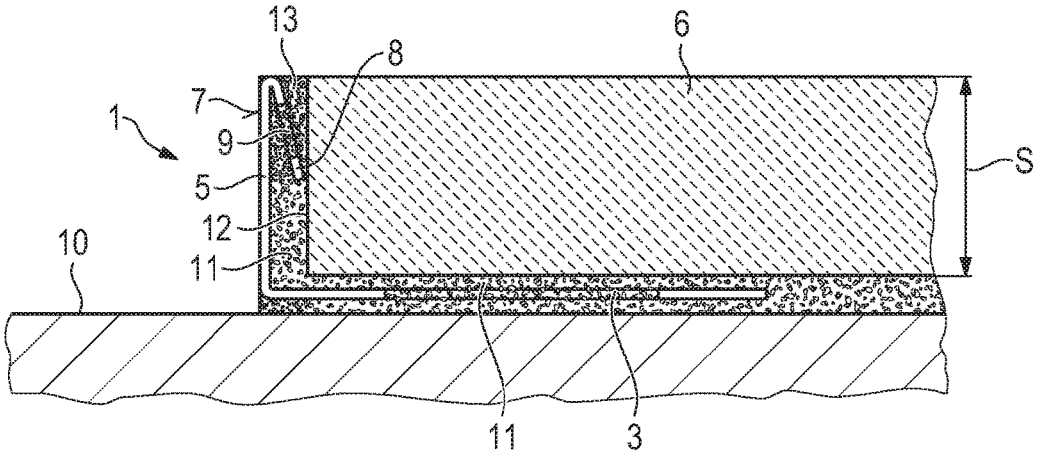
FIG. 3 is a sectional side view of the profile shown in FIG. 1 in a first installed condition.

FIG. 3 shows the profile 1 in a first installed condition, in which the profile 1 is used to terminate a tiling of tiles 6 installed in a common plane. To install the arrangement shown in FIG. 3, in a first step the profile 1 is positioned on the base 10 using a thin-bed mortar 11 in such a way that the end faces 12 of the row of tiles 6 to be terminated abut the stop leg 8 of profile 1, whereby an upwardly expanding wedge-shaped joint space is formed between these end faces 12 and the stop leg 8. The thin-bed mortar penetrates the passage openings 3 of the fastening leg 4, so that the profile 1 is securely held to the base 10 after the thin-bed mortar 11 has cured. In a further step, the joint space is filled from above with a grout 13, which penetrates through the through holes 9 of the stop leg 8 and interlocks itself accordingly, so that the grout 13 is firmly connected to the stop leg 8 of the profile 1 after curing.

A major advantage of the profile 1 is that it has a very simple structure, which can be produced in particular by bending a metal strip and thus inexpensively, whereby the metal strip can already have the desired surface finish of the visible outside 7 of the boundary leg 5 and the passage openings 3 and 9. The stop leg 8 acts as a distancing projection, which ensures simple and even adjustment of the joint width to be filled with grout 13. At the same time, the through holes 9 provided in the stop leg 8 ensure that grout 13 can be securely interlocked despite the comparatively small joint size.

Figure 4:
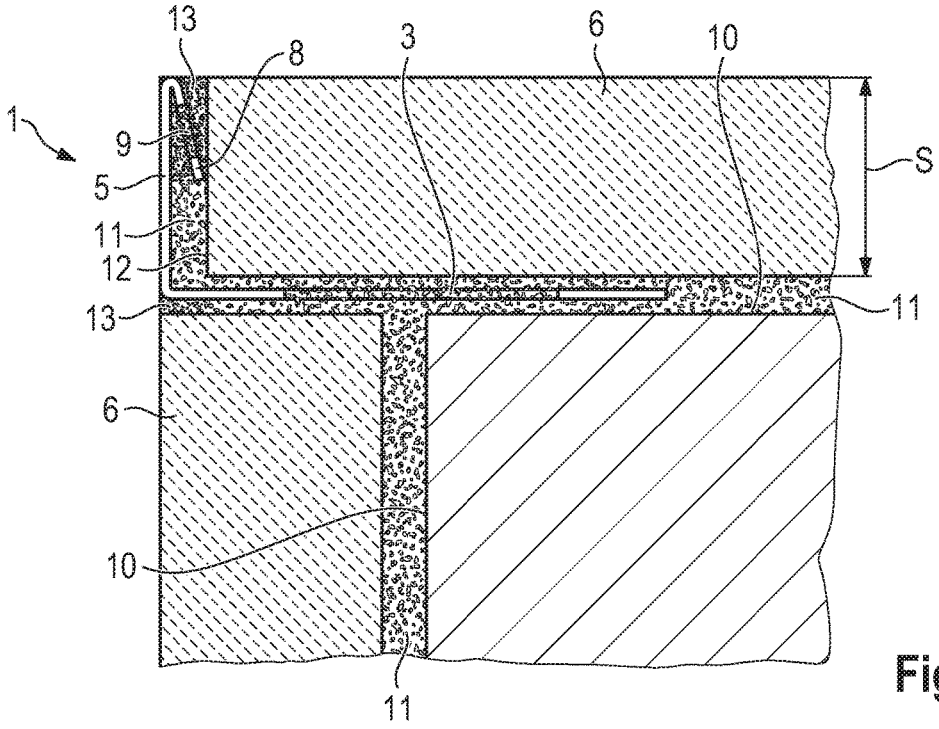
FIG. 4 is a sectional side view of the profile shown in FIG. 1 in a second installed condition.

FIG. 4 shows the profile 1 in another installed condition, in which profile 1 is used to terminate adjacent tilings along the exposed end faces of the outer rows of tiles 6 in the corner area defined by the tilings. The arrangement shown in FIG. 4 is installed by first fixing the vertically extending tiles 6 to the associated base 10 using thin-bed mortar 11. A thin-bed mortar is then applied to the exposed end faces 12 of the tiles 6 already installed and to the horizontal base 10. In a further step, the fastening leg 4 of profile 1 is pressed into the thin-bed mortar 11 and aligned with the tiles 6 already laid. Then the horizontally extending tiles 6 are laid in the already applied thin-bed mortar 11, whereby the end faces 12 of the tiles 6 facing profile 1 are positioned in such a way that they contact the stop leg 8 of profile 1. In order to be able to apply grout 13 between the fastening leg 4 and the covered end faces 12 of the tiles 6, the joint space must be kept free of thin-bed mortar. In a final step, the joints remaining between the tiles 6 and the profile 1 are filled with grout 13, which in turn penetrates the through holes 9 of the stop leg 8.

Figure 5:
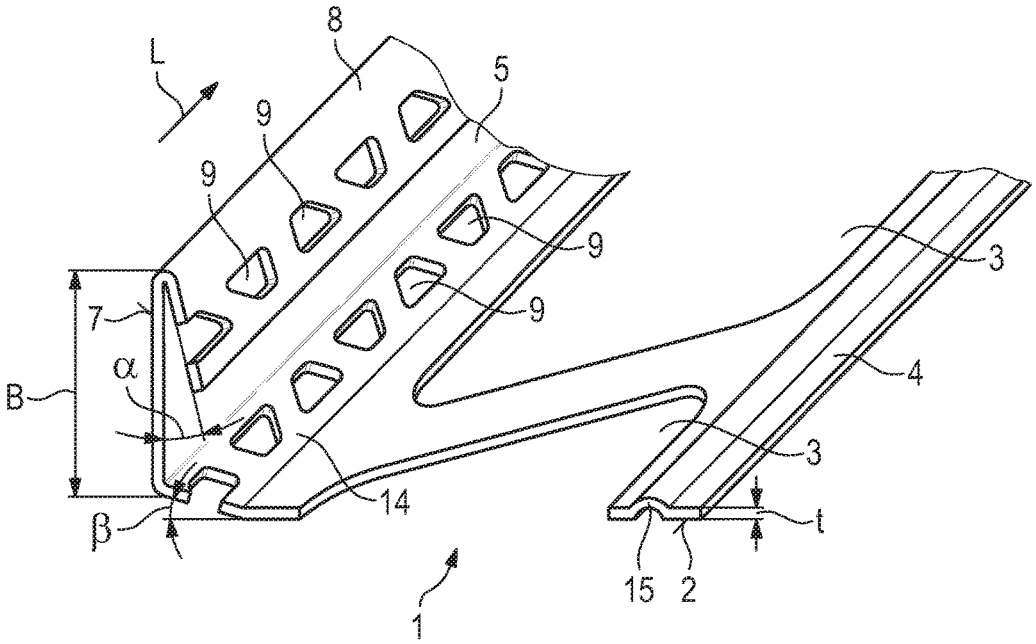
FIG. 5 is a perspective view of a profile according to a second embodiment of the present invention.
Figure 6:
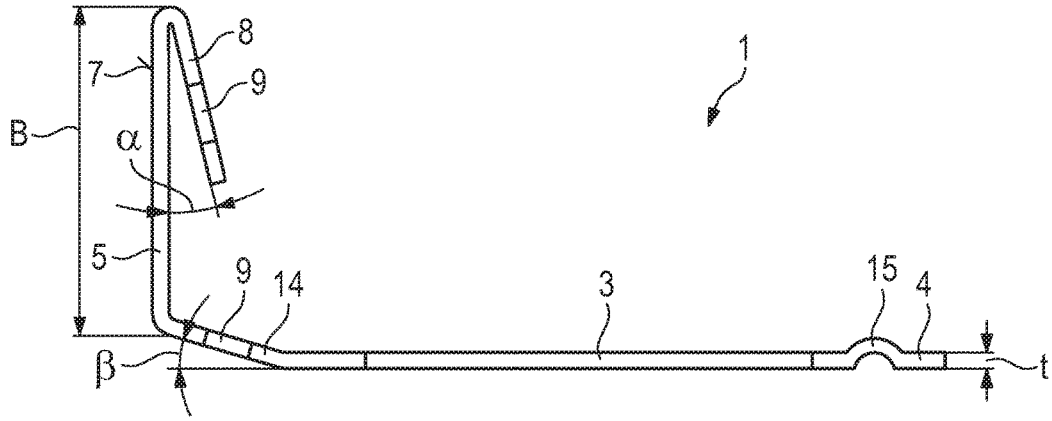
FIG. 6 is a side view of the profile shown in FIG. 5.

FIGS. 5 and 6 show a profile 1 according to a second embodiment of the present invention, which has substantially the same structure as profile 1 shown in FIGS. 1 to 4. A first difference is that the fastening leg 4 and the boundary leg 5 do not merge directly into one another but are connected to one another via a connecting leg 14, which encloses an angle $\beta$ in the range between 3 and 20° with the fastening leg 4, in particular an angle between 5 and 15°, the connecting leg 14 also being provided with a plurality of through holes 9, which are arranged over the connecting leg 14 in the longitudinal direction L in a substantially uniform distribution. In addition, there is another difference in that the fastening leg 4 is provided with a stiffening bead 15 extending in the longitudinal direction L, which projects upwards in the direction of the boundary leg 5 and extends in this case across the entire length of the fastening leg 4. In this case, the stiffening bead 15 has a depth t which substantially corresponds to the material thickness of the fastening leg 4.

Figure 7:
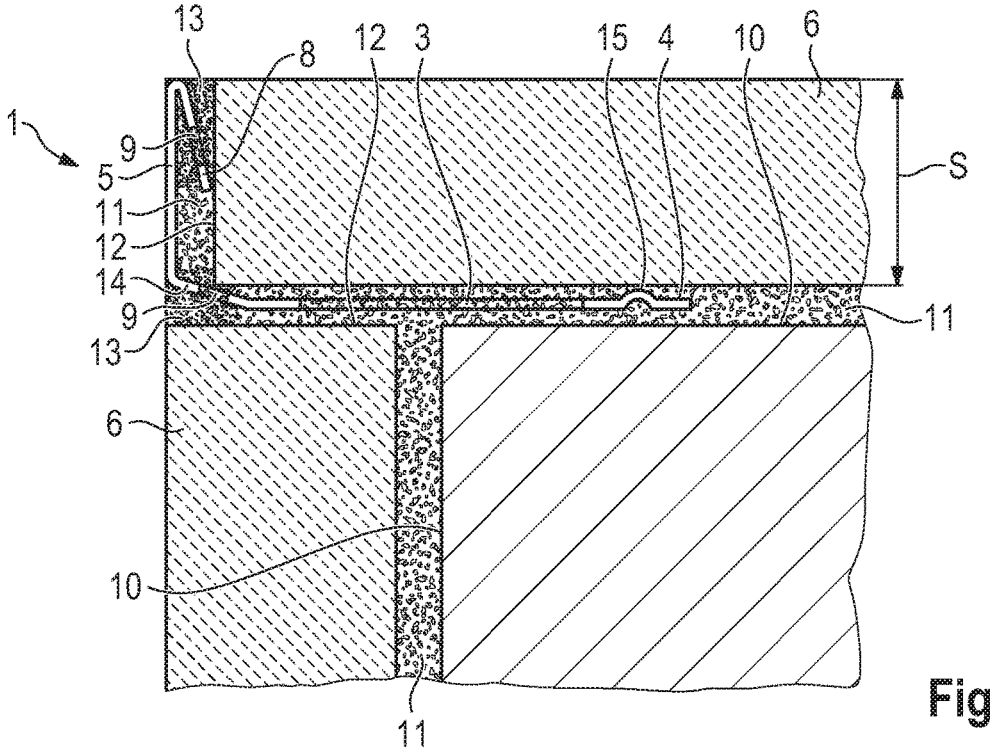
FIG. 7 is a sectional side view of the profile shown in FIG. 5 in an installed condition.

The advantage of the stiffening bead 15 is that inadvertent bending of the profile 1 during storage, transport or handling is prevented. As a result damages of profile 1 appear less frequently. The advantage of the connecting leg 14 comes into play when profile 1 is laid in a corner area, as shown in FIG. 7. The connecting leg 14 defines a further joint in an optically desired visible width between profile 1 and the tiles 6 arranged vertically, which is filled with grout 13, which in turn penetrates the through holes 9 of the connecting leg 14 and clings to the connecting leg 14.

Figure 8:
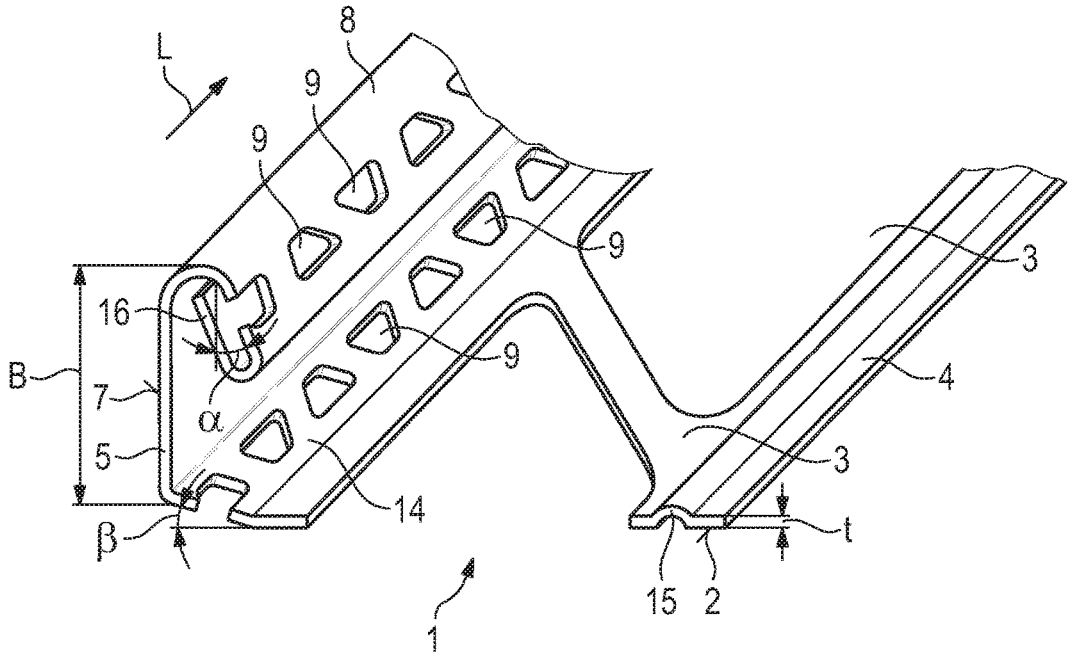
FIG. 8 is a perspective view of a profile according to a third embodiment of the present invention.
Figure 9:
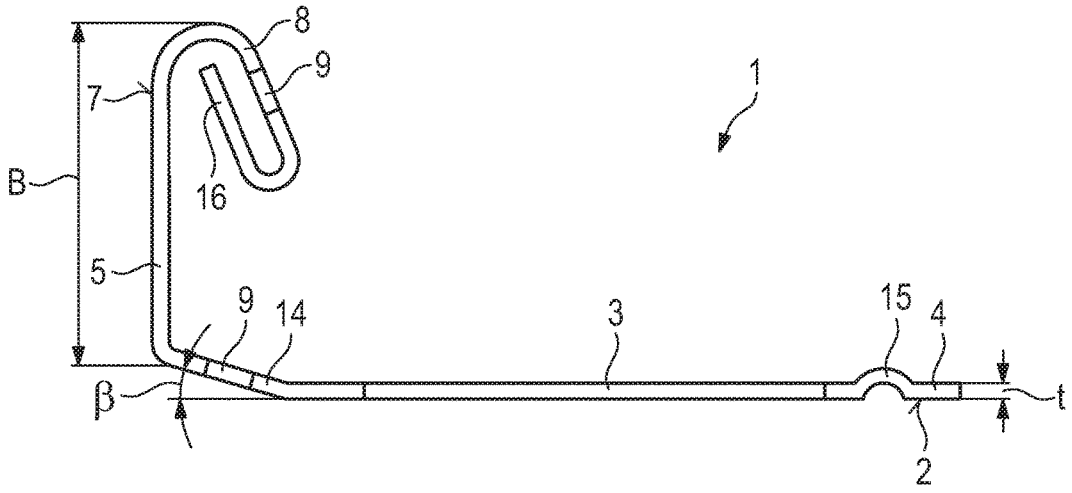
FIG. 9 is a side view of the profile shown in FIG. 8.
Figure 10:
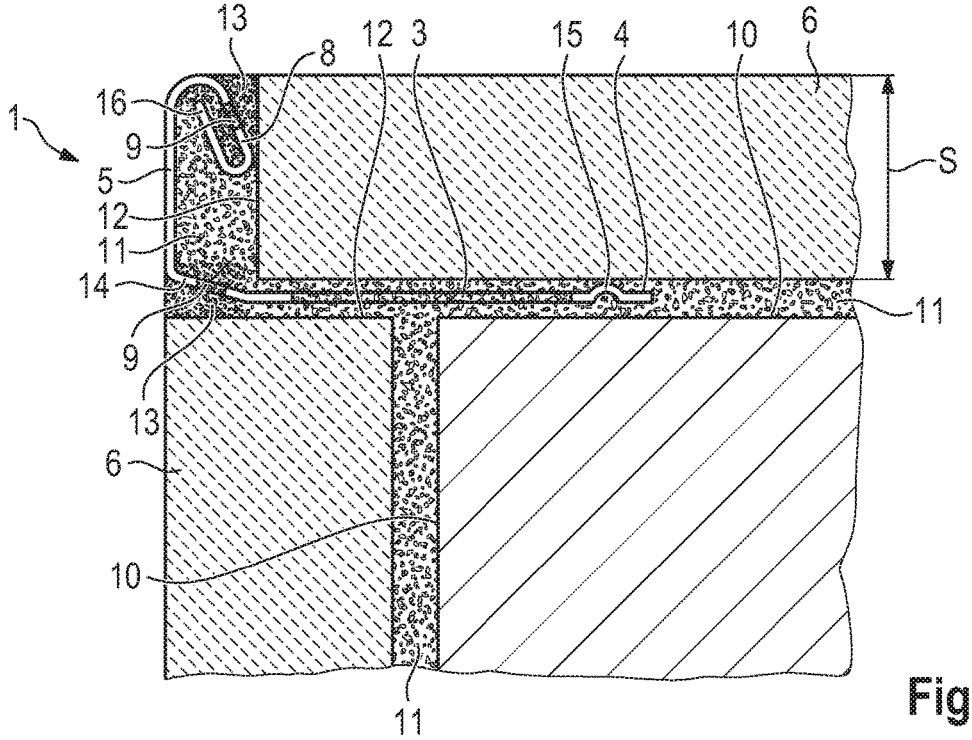
FIG. 10 is a sectional side view of the profile shown in FIG. 8 in an installed condition.

FIGS. 8 and 9 show a profile 1 according to a third embodiment of this invention, which differs from profile 1 according to the second embodiment of this invention in that an end leg 16, which defines a free end of the curved tile end profile 1, adjoins the stop leg 8. The end leg 16 extends in the direction of the boundary leg 5 and, in this case, is bent 180° inwards from the stop leg 8 and extends parallel to it at a distance of at least 1.5 mm. The advantage of such an end leg 16 is that, together with the stop leg 8, it defines a grout absorbing space which limits the amount of grout 13 to be absorbed and thereby favors the interlocking of the grout 13 penetrating the through holes 9 of the stop leg 8. This can be seen in FIG. 10. The gap space can also be wedge-shaped by selecting an angle slightly smaller or larger than 180°. The end leg 16 can also lie flat on the back of the stop leg 8. In this case, only the through holes 9 remain for interlocking the grout 13.

Figure 11:
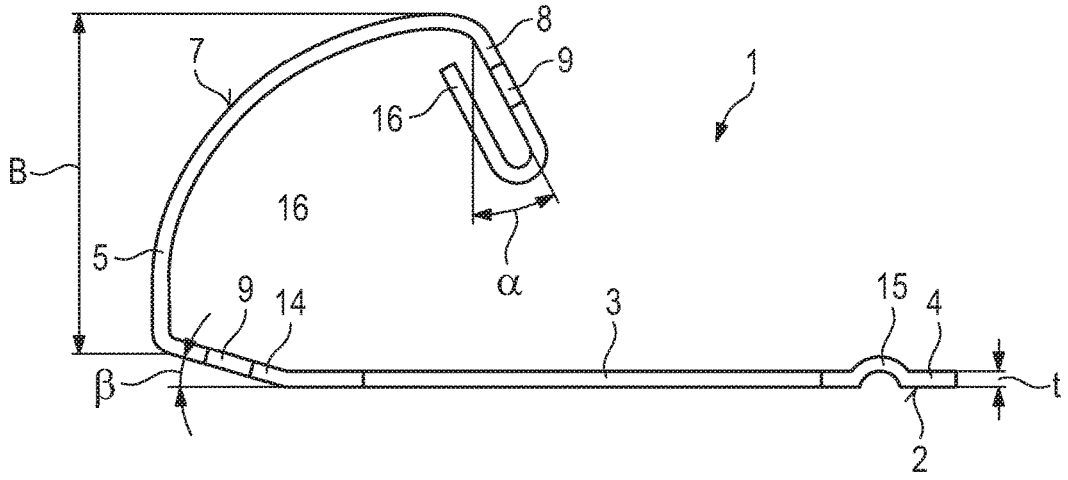
FIG. 11 is a side view of a profile according to a fourth embodiment of the present invention.
Figure 12:
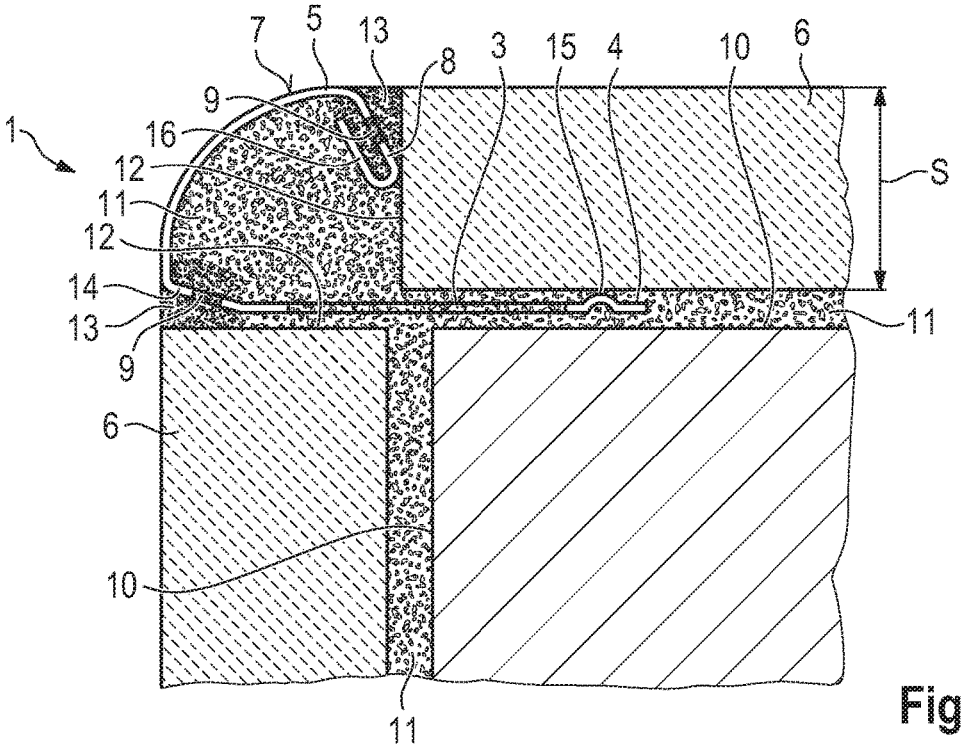
FIG. 12 is a sectional side view of the profile shown in FIG. 11 in an installed condition.

FIG. 11 shows a profile 1 according to a fourth embodiment of the present invention, which differs from the third embodiment in that the boundary leg 5 has a circular arc-shaped curve extending over substantially 90°. FIG. 12 shows a possible installation condition of such a tile end profile 1.

Figure 13:
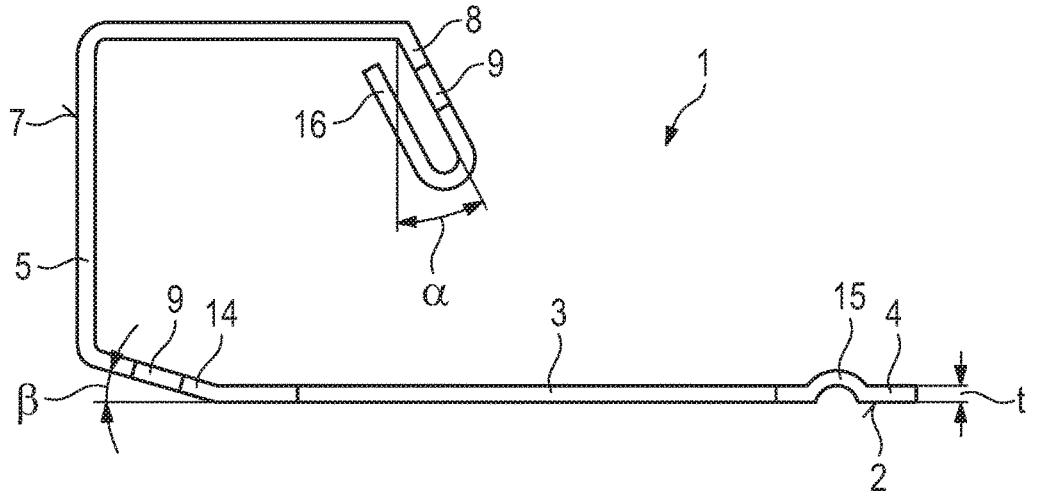
FIG. 13 is a side view of profile in accordance with a fifth embodiment of the present invention.
Figure 14:
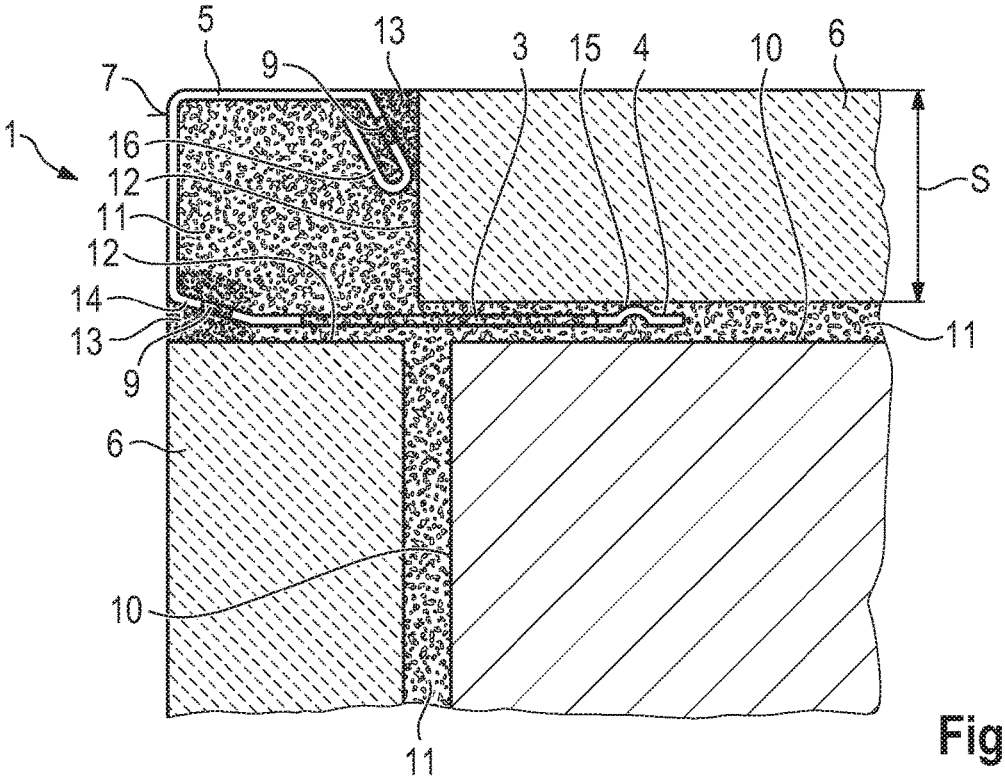
FIG. 14 is a sectional side view of the profile shown in FIG. 13 in an installed condition.

FIG. 13 shows a profile 1 according to a fifth embodiment of the present invention, which differs from the third embodiment in that the boundary leg 5 is L-shaped. FIG. 14 shows a possible installation condition of such a tile end profile 1.

It should be clear that the previously described embodiments of profiles 1 according to the present invention are not to be understood as restrictive. Rather, modifications and changes are possible without leaving the scope of protection of the present application, which is defined by the attached claims. Above all, the boundary leg 5 may have different contours than shown in accordance with the intended application. The formation of the gap is generally advantageous in all embodiments to allow for the absorption of the grout.

REFERENCE CHARACTER LIST

1 tile end profile
2 contact surface
3 passage openings
4 fastening leg
5 boundary leg
6 tiles
7 outside
8 stop leg
9 through hole
10 base
11 thin-bed mortar
12 end face
13 grout
14 connecting leg
15 stiffening bead
16 end leg
B width
S thickness
α angle
L longitudinal direction
β angle
t depth

I claim:

1. An elongate profile (1) for terminating installed tiles, comprising:

viewed in cross-section, a fastening leg (4) for fixing the profile to a base (10), wherein the fastening leg (4) defines a contact surface (2) and is provided with passage openings (3), and a boundary leg (5) adjoining the fastening leg (4) substantially vertically, wherein an outside (7) of the boundary leg (5) defines a visible surface; wherein a stop leg (8) is further provided directly adjacent to the boundary leg (5) and extending downwardly in the direction of the fastening leg (4), the stop leg (8) including an angle (α) with the boundary leg (5) in the range between about 5 degrees and about 30 degrees and having a plurality of through holes (9).

2. Profile (1) according to claim 1, wherein the profile is manufactured in one piece.

3. Profile (1) according to claim 1, wherein the profile is bent from a metal strip, the metal strip being manufactured from stainless steel, brass or aluminium and/or having a uniform material thickness of 0.4 to 1.2 mm.

4. Profile (1) according to claim 3, wherein the metal strip has a uniform material thickness of about 0.5 mm to about 0.8 mm.

5. Profile (1) according to claim 1, further comprising an end leg (16) adjoining the stop leg (8) and extending in the direction of the boundary leg (5).

6. Profile (1) according to claim 5, wherein the stop leg (8) and the end leg (16) extend substantially parallel to each other at a distance in the range between about 0.5 and about 2 mm.

7. Profile (1) according to claim 1, wherein the boundary leg (5) has a circular arc-shaped curve extending across substantially 90°.

8. Profile (1) according to claim 1, wherein the boundary leg (5) is formed L-shaped.

9. Profile (1) according to claim 1, wherein the fastening leg (4) and the boundary leg (5) are connected to one another via a connecting leg (14) which encloses an angle (β) between 3 and 20° with the fastening leg (4), and is provided with a plurality of through holes (9).

10. Profile (1) according to claim 9, wherein the fastening leg (4) and the boundary leg (5) are connected to one another via the connecting leg (14) which encloses an angle (β) between about 5 degrees and about 15 degrees with the fastening leg (4).

11. A Profile (1), comprising:

viewed in cross-section, a fastening leg (4) for fixing the profile to a base (10), wherein the fastening leg (4) is provided with through holes (3), and a boundary leg (5) adjoining the fastening leg (4) substantially vertically, wherein the outside (7) of the boundary leg (5) defines a visible surface, wherein the fastening leg (4) is provided with at least one stiffening bead (15) extending in the longitudinal direction (L) and projecting in the direction of the boundary leg (5), the at least one stiffening bead (15) having a depth (t) which substantially corresponds to the material thickness of the fastening leg (4).

12. Profile (1) according to claim 11, wherein the at least one stiffening bead (15) extends over the entire length of the fastening leg (4).

13. Profile (1) according to claim 11, wherein multiple stiffening beads (15) extending in the longitudinal direction (L) and parallel to one another are provided over the entire length of the fastening leg (4).

* * * * *